United States Patent [19]

Richardson et al.

[11] 4,385,403

[45] May 31, 1983

[54] GARMENT PLACKET AND METHOD OF FORMING

[75] Inventors: Donald Richardson, Atkinson, N.H.; Joop F. Hoekstra, Medfield, Mass.

[73] Assignee: The Reece Corporation, Waltham, Mass.

[21] Appl. No.: 251,050

[22] Filed: Apr. 6, 1981

[51] Int. Cl.[3] ..... A41D 27/00

[52] U.S. Cl. ..... 2/96; 2/128; 2/218; 2/235; 2/270

[58] Field of Search ..... 2/218, 96, 125, 128, 2/270, 266, 234, 235; 112/440, 441, 65

[56] References Cited

U.S. PATENT DOCUMENTS

| | | | |
|---|---|---|---|
| 2,102,223 | 12/1957 | Roseman | 2/38 |
| 2,345,186 | 3/1944 | Elkes | 2/218 X |
| 2,573,359 | 10/1951 | Rich | 112/65 |
| 2,676,557 | 4/1954 | Silverberg | 112/65 X |
| 2,731,644 | 1/1956 | Matthies | 2/266 |
| 2,805,423 | 9/1957 | Spector | 2/125 |
| 3,105,973 | 10/1963 | Stiefelmeier | 112/65 X |
| 3,174,201 | 3/1965 | Roseman | 24/205 |
| 3,217,335 | 11/1965 | Bell | 2/218 X |
| 3,449,764 | 6/1969 | De Fazio et al. | 2/96 |

OTHER PUBLICATIONS

McCall's Pattern No. 6417.

*Primary Examiner*—H. Hampton Hunter
*Attorney, Agent, or Firm*—Garrett J. Cullen, Jr.

[57] ABSTRACT

The invention relates to a garment placket and the method of forming it in which two pieces of material are folded and attached to the garment in such a manner as to present finished edges for the slit in the garment and which pieces also overlie the placket opening to present a closed appearance thereto. The two pieces of material are attached to the garment in such a manner that both lie completely on one face of the garment.

11 Claims, 13 Drawing Figures

GARMENT PLACKET AND METHOD OF FORMING

BACKGROUND OF THE INVENTION

In forming articles of apparel, it is often necessary to provide a finished slit, called a placket, which enables the wearer to more easily don and remove the garment. Among the more common uses of plackets in garments are at the neck, waist and sleeve cuff areas.

In forming plackets, a slit is first formed in the garment at the desired area, and then the edges of the slit are provided with finished edges to present a pleasing and closed appearance. Various methods are presently used to form the plackets.

One method is to provide the placket along a seam and provide enough material along each of the edges of the slit to enable each edge to be folded back and sewn to itself to form the finished overlapping portions closing the slit. However, the disadvantage to this method is that excess material must be provided along the seam which results in large amounts of waste material when cutting the garment parts from the base material.

A second method is to provide two separate pieces of material each folded and sewn to the garment along an edge of the slit so that the raw edges of the slit extend and lie within the folds of the placket-forming pieces, with the pieces overlapping each other to close the slit.

A third method is to provide a single piece of material which is folded on itself on a longitudinal direction and then is attached to the slit starting on one side at the open end of the slit and then proceeding up around the closed end of the slit and thence down the other side to the open end of the slit. The raw edges of the slit are placed between the folds of the placket material during the stitching, and the width of the fold is such as to form a closure for the slit.

In both the second and third methods, the material forming the placket has a portion disposed on each side of the garment. Further, each of those portions has its edge rolled under so that no raw edges of material are exposed. This results in not only having the rolled edges extending back across the placket opening, but also the garment material which lies within the placket forming material also extends across the placket opening. This creates greater bulk across the placket opening. Further, in the third method it is difficult to retain the fold in the placket material in the position at the closed end of the placket opening, and therefore it sometimes protrudes on the face side of the garment, giving an unsightly appearance.

SUMMARY OF THE INVENTION

The object of the invention is to provide a placket in a garment wherein the placket is finished by using two pieces of material attached to the garment in such a manner that they lie completely on one face of the garment.

Another object is to provide a central cut for the placket opening and then fold back the edges thereof so that sufficient strength will be retained in the area of the placket opening.

A further object is to provide a placket wherein the outer placket facing completely overlaps the under placket facing to present a single flap appearance and to provide sufficient fullness to the placket which will prevent gaping of the placket opening.

In the method of the invention, the garment is slit at the appropriate position in such a manner as to provide a squared closed end to the slit. The raw edges are then folded back on one face of the garment material and are covered by the placket-forming material which is attached to the garment. Thus, one side of the garment will present a completely smooth surface, and all edges will have a finished appearance.

It is understood that the foregoing is merely an illustration of the placket and method of the invention. For a more complete understanding of the invention and its advantages, reference should be made to the following detailed description of the preferred embodiment and to the accompanying drawings.

DESCRIPTION OF THE DRAWINGS AND PREFERRED EMBODIMENT

Figure 6:
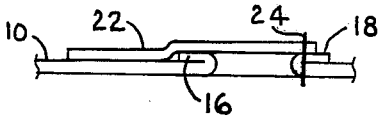
Figure 5:
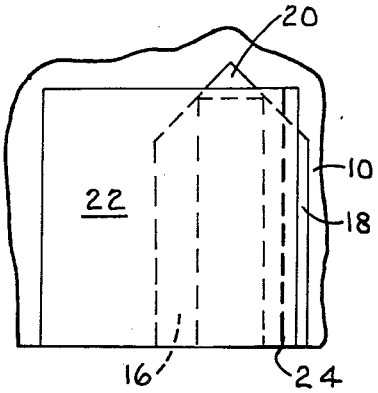
FIG. 5 is a top view of the garment showing the under placket facing material placed over the opening and the first row of stitches attaching it to the garment.
Figure 7:
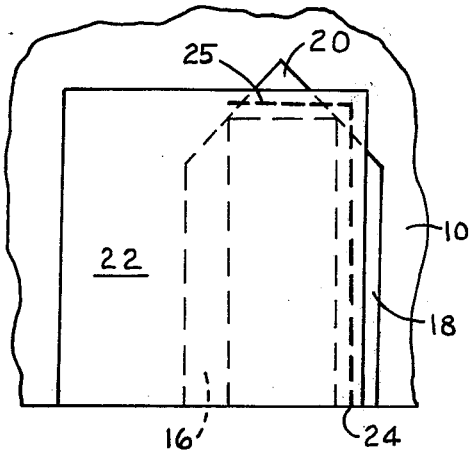
Figure 8:
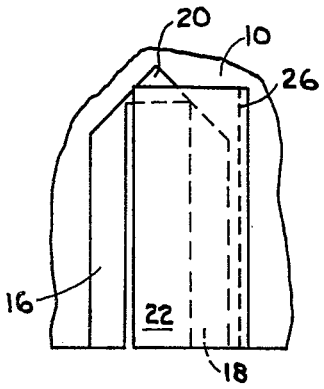
Figure 9:
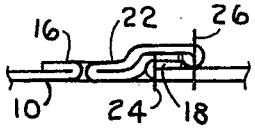
Figure 10:
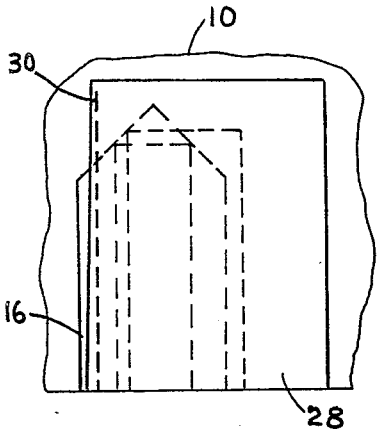

FIG. 6 is an end view of the garment showing the position of the material and stitches of FIG. 5, FIG. 7 is a top view of the garment showing a modified form of stitching for securing the under placket facing to the garment, FIG. 8 is a top view showing the under placket facing material doubled back on itself and stitched in position, FIG. 9 is an end view of the garment showing the position of the material and stitches of FIG. 9, FIG. 10 is a top view showing the outer placket facing positioned on the garment and the initial row of stitches securing it in place.

Figure 11:
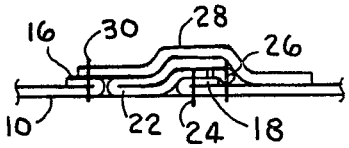

FIG. 11 is an end view of the garment showing the position of the material and stitches of FIG. 10.

Figure 12:
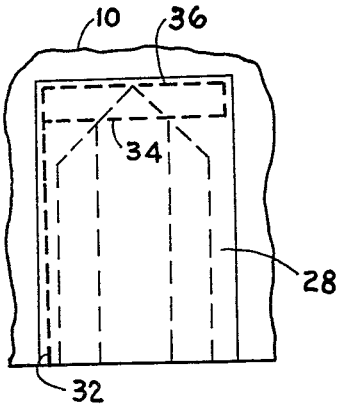
Figure 13:
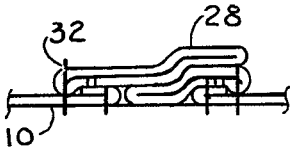

FIG. 12 is a top view showing the outer placket facing doubled back on itself and stitched in position to provide the finished placket opening, and FIG. 13 is an end view of the garment showing the position of the material and stitches of FIG. 12.

Figure 1:
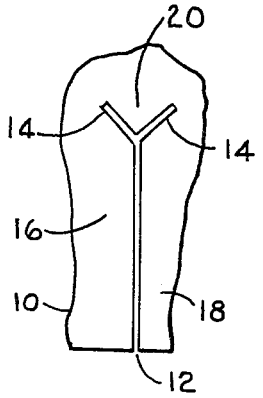
FIG. 1 is a top view of a portion of a garment showing the placket slit formed therein.
Figure 2:
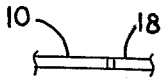
FIG. 2 is an end view of the garment showing the slit of FIG. 1 formed therein.

Referring now to FIG. 1, there is shown a garment portion 10 placed face side up, which could be a sleeve, skirt or neck portion of a shirt, in which it is desired to form a placket opening. A longitudinal slit 12 is formed in the garment 10 extending inwardly from the edges thereof. The inner end of the slit 12 terminates in two outwardly diverging portions 14. There are thus formed two longitudinal flap edges 16 and 18 along the sides of the slit and V-shaped tab 20 at the end of the slit.

Figure 4:
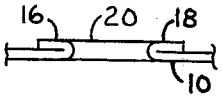
FIG. 4 is an end view of the garment showing the position of the folded edges of FIG. 3.
Figure 3:
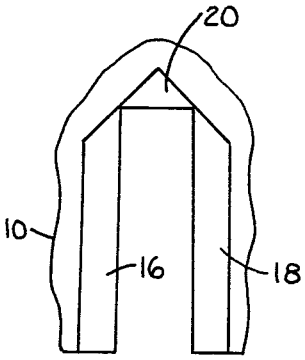
FIG. 3 is a top view of the garment showing the edges of the slit folded back.

The next step in forming the placket is to fold the two flap edges 16 and 18 and the V-shaped tab 20 back on the face side of the garment to provide the enlarged opening of FIG. 3 and having finished edges along the opening. By utilizing the slit 14 to form the tab 20, it is possible to provide a square end to the opening. Also, the rear side of the garment still has its smooth surface, as seen in FIG. 4.

A piece of material 22, which is to form the underfacing for the placket, is placed face down on the garment with one edge in line with the free edge of the garment material, as shown in FIGS. 5 and 6. The opposite edge of the underfacing extends just beyond the closed end of the opening which was formed in the material 10. One side edge of the under facing 22 is located between the free edge of flap 18 and the folded edge of the opening in the garment 10. A row of stitches 24 is then sewn through the under facing 22, the flap 18 and garment 10 to secure the under facing 22 and the flap 18 in position. The opposite edge of the under facing 22 extends across the opening and beyond the free edge of flap 16.

In FIG. 7 there is shown an alternative form of initially securing the underfacing forming piece of material 22. In this construction, after forming the first row of stitches 24 to secure the material 22 to flap 18 and garment 10, a second row of stitches 25 is sewn through the material 10, the tab 20 and the garment 10. This row of stitches has one end terminating at the row of stitches 24 and its other end terminating adjacent the opposite side edge of the opening formed in the garment by the folded back flap 16. This row of stitches 25 will serve several purposes. The first being that during subsequent operations the tab 20 will be retained in its proper position. This row of stitches 25 will also assure that the underfacing material 22 will retain its proper alignment during subsequent folding as well as while the facing material 28 is being attached. Finally, the end of the row of stitches 25 away from the line of stitches 24 will provide a guide for the next fold to be formed in the piece of underfacing material 22.

The under facing 22 is now folded back on itself along a line closely adjacent the finished edge of the opening formed by the flap 16. The under facing is further folded under along a line outwardly of the free edge of flap 18 as best illustrated in FIGS. 8 and 9. A line of stitches 26 is then sewn through the garment material 10 and the under facing 22 closely adjacent the fold formed by the under turned free edge of the under facing 22. Thus, one edge of the opening in the garment material 10 adjacent the flap 18 is provided with a completely finished appearance with no raw edges showing, as seen in FIG. 9. Further, by starting with the under facing material face down on the face of the garment material, the exposed surface of the under facing will match the face surface of the garment material.

The next step is to place the material for forming the placket facing face down on the garment in overlying relationship to the under facing 22. The placket facing 28 is substantially longer and wider than the under facing material 22. One edge of the placket facing material 28 is aligned with the free edge of the garment material 10, while the opposite edge extends beyond the closed end of the opening and beyond the folded back tip of the V-shaped tab 20 as best seen in FIG. 10. One side edge of the placket facing material 28 is located between the free edge of flap 16 and the folded edge of the opening in the garment 10. A row of stitches 30 is then sewn through the placket facing material 28, the flap 16 and garment 10 to secure the placket facing material 28 and flap 16 in position. The opposite side edge of the placket facing material 28 extends a substantial distance beyond the folded under edge of under facing 22.

The placket facing material 28 is now folded back upon itself along a line corresponding to the folded under edge of under facing 22 so that the two folds will coincide. The free side edge of the placket facing material 28 is then folded under along a line outwardly of the free edge of flap 16 as best seen in FIGS. 12 and 13. A line of stitches 32 is then sewn through the garment material 10 and the placket facing material 28 closely adjacent the fold formed by the under turned free edge of the placket facing material 28. Once again all raw edges along the side of the placket opening will be completely covered to present a finished appearance, and all extra material will be located on one face of the garment as seen in FIG. 13. Further, the exposed face of the placket facing material 28 will match the face side of the garment 10.

A row of stitches 34 is then sewn across the upper end of the folded placket facing material 28 from the line of stitches 32 to a point closely adjacent the folded edge formed by the first fold placed in the placket facing material 28. This line of stitches 34 passes through the folded placket facing material 28, the garment material 10, and the V-shaped tab 20 adjacent the folded edge formed when the tab 20 was folded back on the material. Thus, the upper end of the folded placket facing material 28 will be secured in position across its width, as well as locking the folded V-shaped tab 20 in position. At this point the side edges as well as the closed end will all have completely finished ends.

The final step in finishing the placket is to turn under the free edges of the upper end of the placket facing material 28 and to sew a row of stitches 36 closely adjacent the fold thus formed to completely enclose the V-shaped tab 20. While a rectangular pattern has been shown, it is obvious that this end could be rounded or shaped in the form of a triangle without departing from the scope of this invention. Depending upon the use of the placket, a cuff in the case of a sleeve, a collar in the case of a shirt, or a binding in the case of a skirt, would be attached to the free edge of the garment 10 to completely enclose those raw edges.

While this invention has been described as using rows of stitches 24, 25, 26, 30, 32, 34, and 36 to secure the various parts together and in proper position it is obvious that other types of securement can be used in place of one or more of these rows of stitches. Among these are the use of pressure in the presence of adhesives (either pressure sensitive or hot melt) as well as, in the case of the materials containing sufficient quantities of man-made fibers, the use of heat generated electrically, ultrasonically or by radio frequency.

By starting with the under facing material 22 having one edge located between the free edge of the flap 16 and the folded edge of the opening and extending across the opening, the placket can be made to open from the opposite direction. This would be utilized in the construction of right and left hand sleeves, as well as in men's and women's clothing which open from opposite directions.

It is to be understood that the invention is not limited to the embodiment shown and described, but many changes and modifications can be made without departing from the invention as defined in the appended claims.

What is claimed is:

1. A placket for a garment comprising, an elongated opening extending inwardly from one edge of the material forming the garment, the edges of the material adjacent said opening being folded back upon one face of the garment along the sides and the end of the opening to provide a finished rolled edge for the opening in the garment material, an underfacing overlying the opening and secured to the garment material along one side of the opening and covering the folded back portion on the said one side of the opening, and a placket facing overlying the underfacing and, secured to the garment material along the other side of the opening and covering the folded back portion on the said other side of the opening.

2. A placket for a garment according to claim 1 wherein, said underfacing is formed of a piece of material having a length greater than the length of the opening, said underfacing material having one side edge lying on the folded back portion of said garment material between the rolled edge and the raw free edge thereof on one side of the opening, with one end aligned with the open end of the opening in the garment material, a line of stitching securing said one side edge to said garment material, said underfacing material being folded back upon itself along a line closely adjacent to the other side of the opening in the garment material, said underfacing being further turned under itself along a line beyond the raw free edge of the folded back portion of the said garment material on said one side of the opening, a line of stitching securing the folded under portion to the garment material closely adjacent the fold, whereby the folded back portion of the garment material is completely covered by the underfacing and all raw edges along said one side of said garment are completely covered.

3. A placket for a garment according to claim 2 wherein said placket facing is formed of a piece of facing material having a length greater than the length of said underfacing with one end aligned with the open end of the opening in the garment material and the other end extending beyond the raw free edge of the folded back portion of the garment material at the closed end of the opening, said placket facing having one side edge thereof lying on the folded back portion of the garment material between the rolled edge and the raw free edge thereof on the other side of the opening, a line of stitches securing said one side edge to said garment material, said placket facing being folded back upon itself along a line on the opposite side of the opening and beyond the stitch line securing the further turned under edge of the underfacing to the garment material, said placket material being further folded under along a line beyond the raw free edge of the folded back portion of the garment material on said other side of the opening, and a line of stitches securing said folded under portion to said garment material adjacent to said fold line.

4. A method for forming a placket in a garment comprising the steps of cutting a longitudinal slit in the garment material at the desired location inwardly from an edge of the garment so as to be open at one end and closed at the other end, folding the edges of the slit back upon one face of the garment to provide an opening having finished edges, securing an underfacing to one side of said openings in covering relationship to the raw folded back edge on the one side of said opening in the garment material, and with the underfacing presenting only folded finished longitudinal edges, securing a placket facing to the other side of said opening in covering relationship to the raw folded back edge on the other side of said opening in the garment material, and with the underfacing presenting only folded finished longitudinal edges, folding the end of said placket facing at the closed end of the slit under itself to present a finished edge, and securing the said finished end to the garment material.

5. A method for forming a placket according to claim 4 comprising the steps of cutting outwardly diverging slits at the opposite end of the longitudinal slit to form a V-shaped tab at the closed end of the slit, and folding the V-shaped tab back upon the said one face of the garment to provide with the folded back edges of the slit a rectangular opening having finished edges.

6. A method for forming a placket according to claim 5 wherein the step of securing the underfacing includes aligning the one end of the underfacing material with the edge of the garment material and with the underfacing material extending over the opening in the garment material, aligning one side edge of the underfacing material in a position along one side of the opening in the garment material between the raw free edge of the folded back portion and the finished folded edge on that side of the garment opening, doubling back said underfacing upon itself along a line adjacent the opposite finished edge of the opening formed in the garment material, turning under said underfacing material along a line away from said opening in the garment material and beyond the raw free edge of folded portion of the garment material, and securing said underfacing material to said garment material by the use of stitches.

7. A method for forming a placket according to claim 6 wherein the step of securing the underfacing to the garment material includes, applying a row of stitches along the one side of the garment material and through the single layer of the underfacing after the underfacing has been initially placed in position and prior to making any folds therein, and applying a second row of stitches to the garment material and the underfacing material adjacent the second fold in the underfacing material after all folds have been made in the underfacing material.

8. A method for forming a placket according to claim 7 wherein the step of securing the underfacing to the garment material includes, applying a row of stitches through the underfacing prior to making any folds therein, and the folded back V-shaped tab at the closed end of the opening closely adjacent the finished end thereof.

9. A method for forming a placket according to claim 7 wherein the step of securing said placket facing includes aligning one end of the placket facing material with the edge of the garment material and with the placket facing covering the opening in the garment material and the underfacing attached thereto, aligning one side edge of the placket facing in a position along the side of the opening opposite the side to which the underfacing is attached between the raw free edge of the folded back portion and the finished folded edge on that side of the garment opening, doubling back said placket facing upon itself along a line lying beyond the turned under edge of the underfacing so as to completely cover said underfacing, turning under said facing along a line away from said opening in the garment material and beyond the raw free edge of the folded portion of the garment material on the side of the opening on which the first edge of the placket facing is located, and securing said placket facing to the garment material by the use of stitches.

10. A method of forming a placket according to claim 9 wherein the step of securing the placket facing to the garment material includes applying a row of stitches through the single layer of the placket facing and the folded back portion of the garment material on the side of the opening opposite the attachment of the underfacing and prior to doubling back the placket facing material upon itself, and applying a second row of stitches to the placket facing and the garment material along a line adjacent the second fold in the placket facing after the second fold has been made.

11. A method for forming a placket according to claim 10 wherein the placket facing is finished at its end opposite the end aligned with the edge of the garment by folding under the raw edge of the end of the placket facing along a line beyond the tip of the V-shaped tab, and applying a line of stitches through the placket facing and the garment material along the folded under raw edge across the width of the folded placket facing, along the first folded edge of the placket facing to a point substantially in line with the closed end of the opening in the garment, across the width of the folded placket facing along a line closely adjacent the closed end of the opening and along the second folded edge of the placket facing to the point adjacent the folded under raw edge of the placket facing from which the stitching started.

* * * * *